US012268279B2

(12) United States Patent
Beech et al.

(10) Patent No.: US 12,268,279 B2
(45) Date of Patent: Apr. 8, 2025

(54) INSOLE

(71) Applicant: Scholl's Wellness Company Limited, Bracknell (GB)

(72) Inventors: Edward John Beech, London (GB); Alexander James Kerr, London (GB); Kaiming Pan, Slough (GB); Daniel John Wood, Slough (GB)

(73) Assignee: Scholl's Wellness Company Limited, Bracknell (GB)

( * ) Notice: Subject to any disclaimer, the term of this patent is extended or adjusted under 35 U.S.C. 154(b) by 0 days.

(21) Appl. No.: 18/037,755

(22) PCT Filed: Nov. 26, 2021

(86) PCT No.: PCT/GB2021/053087
§ 371 (c)(1),
(2) Date: May 18, 2023

(87) PCT Pub. No.: WO2022/112787
PCT Pub. Date: Jun. 2, 2022

(65) Prior Publication Data

US 2023/0413947 A1 Dec. 28, 2023

(30) Foreign Application Priority Data

Nov. 27, 2020 (GB) ..... 2018732

(51) Int. Cl.
*A43B 17/02* (2006.01)
*A43B 17/00* (2006.01)

(52) U.S. Cl.
CPC ..... *A43B 17/026* (2013.01); *A43B 17/006* (2013.01)

(58) Field of Classification Search
CPC ..... A43B 7/1475; A43B 7/148; A43B 7/1485; A43B 7/149; A43B 13/189; A43B 13/40; A43B 17/006; A43B 17/026; A43B 21/265
See application file for complete search history.

(56) References Cited

U.S. PATENT DOCUMENTS 6,176,025 B1 * 1/2001 Patterson ..... A43B 7/1445 36/35 B
6,205,684 B1 3/2001 Snyder
7,146,753 B2 * 12/2006 Khoury ..... A43B 7/148 36/154
7,200,955 B2 * 4/2007 Foxen ..... A43B 7/1445 36/31
2007/0033834 A1 2/2007 Cheskin et al.
(Continued)

FOREIGN PATENT DOCUMENTS

WO 2013006393 A1 1/2013

OTHER PUBLICATIONS

International Search Report for PCT/GB21/53087 mailed Mar. 4, 2022, 5 pages.

*Primary Examiner* — F Griffin Hall
(74) *Attorney, Agent, or Firm* — Lowenstein Sandler LLP

(57) ABSTRACT

An insole (2) has a heel region (8), an arch region (6) and a forefoot region (4). A pod (10) comprising an encapsulated liquid is partially embedded in a foam layer in the heel region (8). The impact of foot strike can lead to large forces on joints in the body. The insole (2) with the pod (10) reduces the impact of foot strike and therefore can lessen the impact of steps on the body.

8 Claims, 4 Drawing Sheets

(56) References Cited

U.S. PATENT DOCUMENTS

| | | | | |
|---|---|---|---|---|
| 2007/0033835 | A1 | 2/2007 | Bray | |
| 2009/0094856 | A1 | 4/2009 | Guerra | |
| 2016/0066647 | A1 * | 3/2016 | Handorf ..... | A43B 7/142<br>36/44 |

* cited by examiner

INSOLE

The impact of foot strike can lead to large forces on joints in the body. An insole can be used to reduce the impact of foot strike and therefore can lessen the impact of steps on the body. For example, during each step the foot impacts the ground. This impact may be referred to as foot strike. The foot strike leads to a force on the foot and body due to the impact of each step.

An insole reduces the impact by using materials that cushion the force associated with a step. The comfort of an insole for a user may be associated with how each step is cushioned and the force distributed in the insole. In general, the cushioning of an insole is dependent upon how a force is cushioned and the area over which the force is distributed.

The present disclosure describes an insole that distributes the force associated with foot strike to provide comfort to the user. The distribution of the force by the insole reduces the peak force on the foot. The insole provides cushioning upon impact over both a sustained period of time and during repeated uses of the insole.

Aspects of the disclosure are also described in detail, by way of example only, with reference to the accompanying drawings, in which.

Figure 4A:
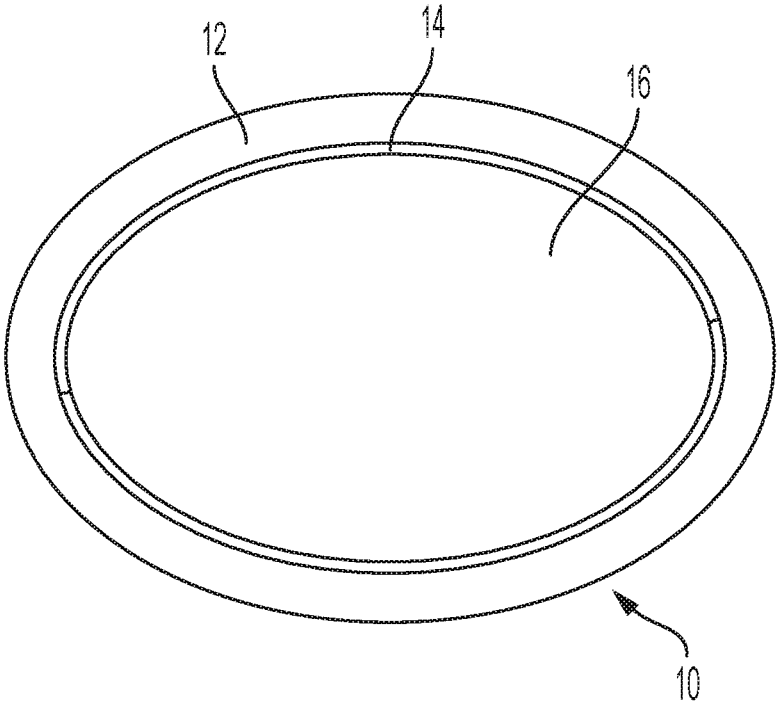
Figure 4B:
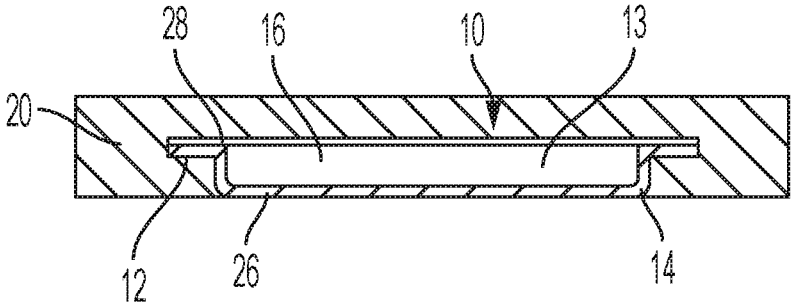

FIG. 4*a* shows a pod to be placed in an insole;

FIG. 4*b* shows a sectional view of the pod shown in FIG. 4*a;*

Figure 4C:
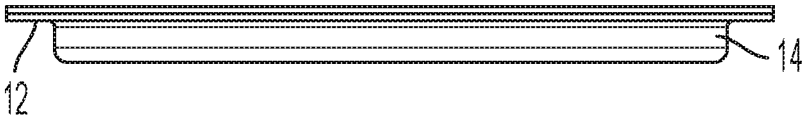

FIG. 4*c* shows a side view of the pod shown in FIG. 4*a*; and

Figure 5:
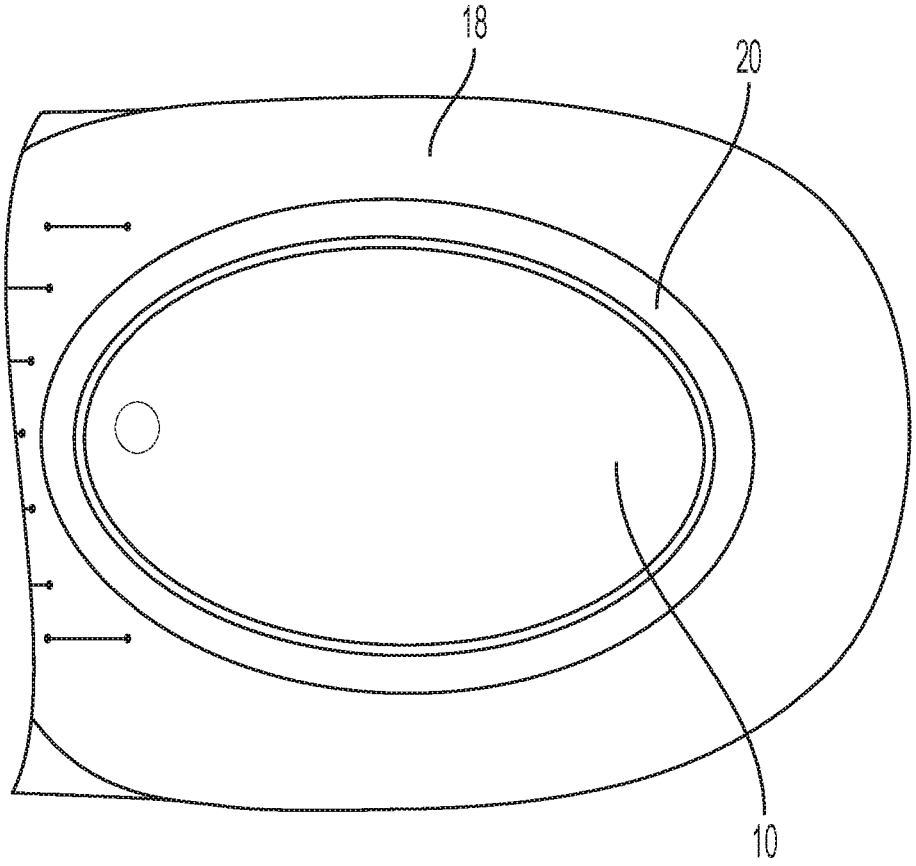

FIG. 5 shows an example of the pod in situ in an insole.

Embodiments will now be described with reference to the Figures.

Figure 1:
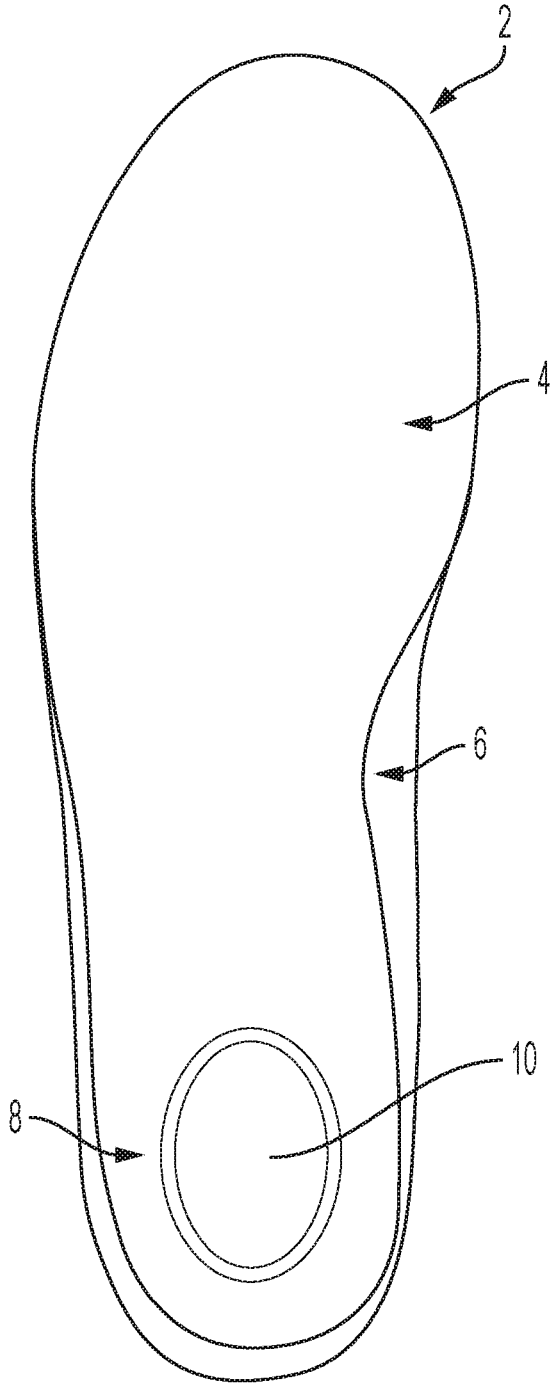
FIG. 1 shows an illustrative view of an insole having a pod.

FIG. 1 shows an illustration of an insole 2 having a pod 10. The insole comprises a heel region 8, an arch region 6 and a ball of foot region 4.

The pod 10 is located in the heel region 8. The positioning of the pod 10 in the heel region 8 allows the pod 10 to cushion the impact of the strike of the heel during a step.

In the example illustrated in FIG. 1, the pod 10 is located in the centre of insole width and in the region corresponding to a user heel would strike the insole 2.

Figure 2:
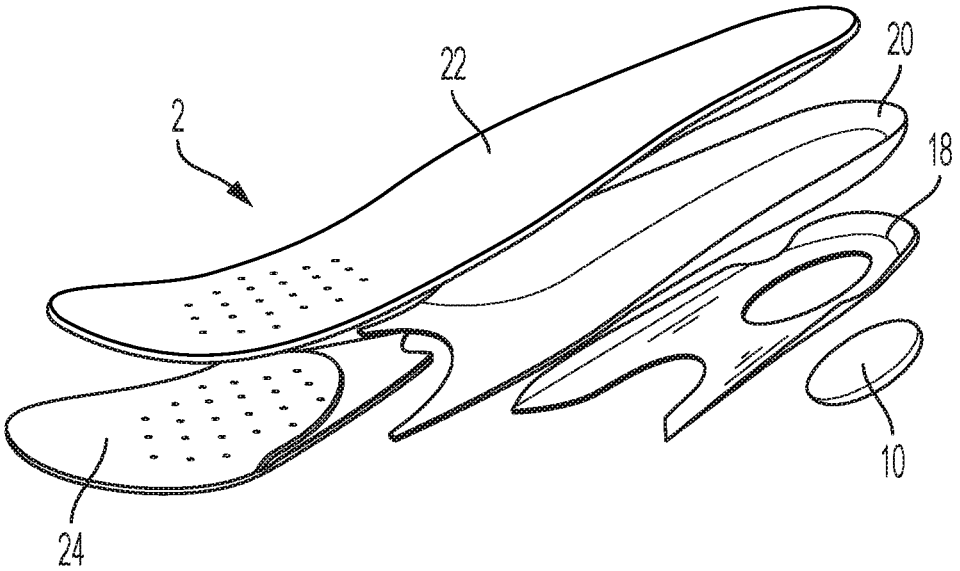
FIG. 2 shows an exploded view of the different layers of an example of the insole.

FIG. 2 shows an example of an insole 2 having a top layer 22, a forefoot portion 24, a ¾ length portion 20, a shell 18 and a pod 10.

In the example illustrated, the top layer 22 comprises a memory foam material and a fabric top cloth, the forefoot portion 24 comprises a TPE gel material, the ¾ length portion 20 comprises a PU foam, the shell part 18 comprises a thermoplastic polyurethane (TPU) and the pod 10 comprises an encapsulated liquid. In this example, the top layer 22 comprises a fabric material on the foot facing portion of the insole which bonded to a memory foam below.

In an example, the heel region comprises a pod and a PU foam layer and the pod comprises an encapsulated liquid and the pod is at least partially embedded in the PU foam layer.

The memory foam of the top layer 22 is formed from a PU material having foam bubbles. In an example the memory foam has a density of 50 g/cm3. The density of the memory foam may be in the range of 40 g/cm3 to 100 g/cm3, for example 45 g/cm3 to 60 g/cm3. The memory foam may have a thickness of 1.5 mm to 3 mm, for example 2 mm to 2.5 mm In an example, the PU foam of the ¾ length portion 20 is selected to have a hardness from 20 Asker C to 40 Asker C, for example 25 Asker C to 35 Asker C, for example 30 Asker C. The thickness of the PU foam may be increased to provide addition cushioning. For example, the PU foam may have a thickness of 0.5 mm to 3 mm, for example 1 mm to 2.5 mm, for example 1.5 mm.

In an example, the TPU material of the shell 18 is selected to have a hardness from 70 Shore A to 120 Shore A, for example 80 Shore A to 110 Shore A, for example 90 Shore A to 100 Shore A, for example 95 Shore A. The TPU material of the shell 18 may have a thickness of 1 mm to 2 mm, for example 1.5 mm.

In an example, the TPE gel material of the forefoot portion 24 is selected to have a hardness from 10 Asker C to 30 Asker C, for example 15 Asker C to 25 Asker C, for example 20 Asker C. The TPE gel material of the forefoot portion 24 may have a thickness of 2 mm to 3.5 mm, for example 2.5 mm to 3 mm.

As illustrated in FIG. 2, the ball of foot region 4, arch region 6 and heel region 8 comprise different materials to provide the appropriate support. In this example, the ball of foot region 4 comprises a gel layer and a memory foam layer, the arch region 6 comprises a PU foam layer and a memory foam layer. The heel region 8 comprises a liquid encapsulated in the pod 10 and the pod 10 is surrounded by a PU foam and a TPU shell 18. In the example shown in FIG. 2, the shell extends to the arch region 6 of the insole. In the example illustrated, the heel region comprises a top memory foam layer, a middle PU foam layer and a bottom pod 10 with the top closest to the foot facing part of the insole and the bottom closest to the shoe facing part of the insole.

Figure 3:
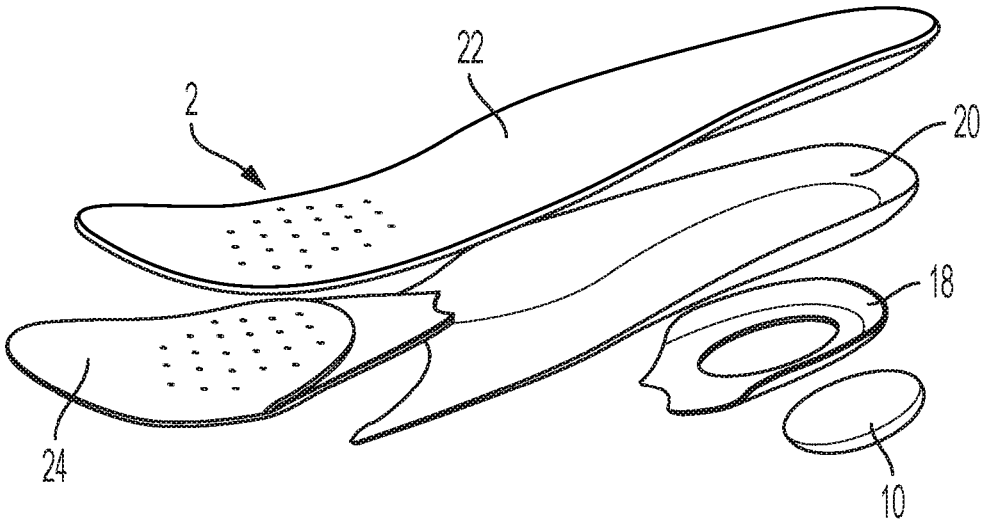
FIG. 3 shows an exploded view of the different layers of a further example of an insole.

FIG. 3 shows a further example of an insole 2 having a pod 10. In this example, the shell part 18 differs from the example illustrated in FIG. 2 with the shell located in the heel region 8 and the arch region 6.

FIG. 5 illustrates the position of the pod 10 in the insole 2. As illustrated, the pod is surrounded by the PU foam on the bottom surface of the insole. For example, the pod 10 is bound laterally by the PU foam of the ¾ portion 20 and the PU foam of the ¾ portion 20 is surrounded by the TPU material of the shell 18. This concentric type structure allows the liquid in the pod 10 to move as pressure is applied by the foot during foot strike. For example, as a force is applied to the pod 10 by the foot the pod expands laterally to accommodate the movement of the liquid in the pod 10 and redistribute the force applied to the pod 10 by the foot. For example, as the pod 10 is compressed vertically by the foot the liquid moves so that the pod expands laterally. The concentric type structure described above provides lateral resistance to the movement of the pod so that the liquid is able to move sufficiently to provide a redistribution of the force during impact whilst restricting that movement to provide sufficient stability.

In the example illustrated, the TPU material of the shell 18 is relatively stiff to inhibit the movement of the PU foam of the ¾ portion 20. The PU foam compresses between the pod and the shell as the pod expands laterally. This compression provides resistance to the expansion of the pod.

In the example shown in FIG. 5, there is a gap of 1 mm between the pod and the PU foam on the bottom surface of the insole. This gap allows the pod to expand without the resistance of the PU foam inhibiting the movement. The gap may range from 0.8 mm to 1.2 mm, for example from 0.9 mm to 1.1 mm.

The size of the pod is selected to target areas of pressure on the foot during impact. In the examples illustrated above, the pod is located in the heel region and the size of the pod is selected to redistribute the force from the heel during foot strike over a wider area. In general, the force from the heel during foot strike peaks in the heel area of the insole and forms a peak force area. Selecting a pod size to be larger than the area of the force from heel during foot strike allows the force to be redistributed to areas away from the peak force area and therefore increases comfort to the user.

The pod illustrated has an elliptical shape with a major axis (i.e. the longest distance from the centre to the edge of the ellipse) measures 28 mm and a minor axis (i.e. the shortest distance from the centre to the edge of the ellipse) measures 18 mm. The pod may have a major axis from 24 mm to 36 mm, for example 26 mm to 30 mm. The pod may have a minor axis from 15 mm to 26 mm, for example 17 mm to 20 mm The size of the pod may differ for different sizes of insole. For example, for an insole sized to fit a shoe sized 3.5 UK the elliptical pod may have a minor axis measuring in the range to 28 mm, for example from 16 mm to 24 mm, for example from 17 mm to 22 mm. The elliptical pod may have a major axis measuring in the range 21 mm to 44 mm, for example from 22 mm to 30 mm, for example from 22.5 mm to 25 mm.

The elliptical pod may be larger for an insole to fit a larger shoe. For example, for an insole sized to fit a shoe sized 8 UK the elliptical pod the elliptical pod may have a major axis measuring in the range 25 mm to 48 mm, for example from 28 mm to 40 mm. The elliptical pod may have a minor axis measuring in the range 17 mm to 31 mm, for example from 17.5 mm to 25 mm.

In the example illustrated, the ratio of the major axis to minor axis of the pod ellipse is 1.56.

FIGS. 4*a*, 4*b* and 4*c* show the pod 10 in more detail. As discussed above the pod encapsulates a liquid. The shape of the pod 10 and the bonding of the pod walls provides sufficient resistance to the increase in pressure associated with the impact of a user's foot on the pod during heel strike.

FIG. 4*a* shows the top view of the pod 10. The pod 10 comprises a centre portion 16, a lip 12 and a side wall 14. The centre portion 16 comprises a cavity for the liquid and impact during a foot strike on the centre portion will displace the liquid. The cavity formed by the centre portion is shown in detail in the cross-sectional view of FIG. 4*b*. As illustrated, the liquid 13 is located in the cavity in the centre portion.

The side wall 14 is shown in detail in FIGS. 4*b* and 4*c*. In the example illustrated, the side wall 14 extends perpendicularly from the bottom of the insole and has a thickness of 0.8 mm. In the example illustrated the film comprises a thermoplastic polyurethane material (TPU) and the capsule comprises a thermoplastic polyurethane material (TPU).

The cross-sectional view shown in FIG. 4*b* shows the pod being formed by a capsule 26 and a film 28. The capsule 26 is bonded to the film 28 at the lip 12. In this example the film 28 and the capsule 26 is bonded using a high frequency weld.

The lip 12 extends around the perimeter of the pod and provides a large surface area for the capsule 26 to bond to the film 28. The large surface area increases the strength of the bond between the capsule 26 and the film 28. The bond strength is related to the burst pressure of the pod. In the example illustrated the lip has a length, measured from the edge of the pod to the end of the lip, of 4.5 mm. The lip length may be from 2.5 mm to 6.5 mm, for example 3 mm to 6 mm, for example 3.5 mm to 5.5 mm, for example 4 mm to 5 mm.

The lip 12 of the pod also allows the pod to be secured in the insole 2. In the example illustrated in FIG. 5, the lip 12 is bonded to the PU foam of the ¾ portion 20. As illustrated in FIG. 5, the lip is enclosed by the ¾ portion 20.

The location of the pod 10 in the PU foam 20 is illustrated in FIG. 4*b*. In this example, the pod is embedded in the PU foam. As illustrated in FIG. 4*b*, the PU foam 20 is located relative to the pod so that the PU foam is located either side of the lip and therefore embeds the pod by having PU foam on either side of the lip of the pod 10. Embedding the pod in the PU foam 20 allows the pod to be secured by the PU foam 20 and inhibits the pod from moving within the insole.

In the example illustrated, the capsule 26 has a thickness of 0.8 mm and film has a thickness of 0.5 mm. The capsule may have a thickness ranging from 0.5 mm to 1.4 mm, for example 0.7 mm to 1.2 mm. The film may have a thickness ranging from 0.5 mm to 1.4 mm, for example 0.7 mm to 1.2 mm.

The pod 10 comprises a liquid that is sealed within a capsule 26 and the film 28. The viscosity and the density of the liquid is selected to provide sufficient cushioning of the force from foot strike whilst also providing stability for the foot. The viscosity and density of the liquid and the encapsulation of the liquid allows the impact of the foot strike to be distributed over a larger area and therefore reduce the peak force on the foot during foot strike. In an example, the liquid has a viscosity of 22,000 cSt 40° C. and density of 0.9 g/cm3. The viscosity of the liquid may range from 18,000 to 24,000 cSt 40° C., for example 20,000 to 23,000 cSt 40° C. The liquid may have a density of 0.7 g/cm3 to 1.1 g/cm3, for example 0.8 g/cm3 to 1.0 g/cm3.

In the examples illustrated above, the insole comprises a pod located in the heel region. In further examples the pod may be located in other regions of the insole that correspond to areas of high-pressure during foot strike, for example the pod may be located in the ball of foot region.

In the examples illustrated above, the insole comprises a single pod. In further examples, the insole may comprise more than one pod. For example, the insole may comprise a first pod in the heel region and a second pod located in the ball of foot region.

In the examples described above the pod has an elliptical shape, the pod may also be circular.

In the examples above, the shell is made from TPU. In other examples, the shell may be made from hard materials such as Nylon.

In an example, the pod may be sized based on the size of the insole. For example, the pod length may be 16% of the insole length and pod width 50% of the insole width. The pod length may range from 10% to 25% of the insole length, for example 13% to 21% of the insole length, for example 15% to 17% of the insole length. The pod width may range from 40% to 60% of the insole width, for example 45% to 55% of the insole width.

Further modifications and developments can be made without departing from the scope of the invention described herein.

The invention claimed is:

1. An insole comprising:

a heel region, an arch region and a forefoot region;

wherein the heel region comprises a pod and a PU foam layer;

wherein the pod encapsulates a liquid, the pod at least partially embedded in the PU foam layer and partially surrounded by the PU foam on the bottom surface of the insole; and wherein the PU foam is separated from the pod on the bottom surface by a gap of 0.8 mm to 1.2 mm.

2. The insole of claim 1, wherein the encapsulated liquid has a viscosity of 18,000 to 24,000 cSt at 40° C. and a density of 0.7 g/cm3 to 1.1 g/cm3.

3. The insole of claim 1, wherein the PU foam layer has a hardness in the range of 20 Asker C to 40 Asker C.

4. The insole of claim 1, further comprising a memory foam top layer.

5. The insole of claim 1, wherein the pod comprises a lip extending around its perimeter, the lip at least partially embedded in the PU foam layer.

6. The insole of claim 1, wherein the pod is configured to redistribute force associated with a heel strike by displacing the encapsulated liquid.

7. The insole of claim 1, wherein the pod is elliptical in shape and has a minor axis in the range of 15 mm to 26 mm.

8. The insole of claim 1, wherein the pod is surrounded by the PU foam layer and a thermoplastic polyurethane shell in a concentric arrangement on the bottom surface of the insole.

* * * * *